US010551123B2

(12) United States Patent
Stegerwald

(10) Patent No.: US 10,551,123 B2
(45) Date of Patent: Feb. 4, 2020

(54) LAUNDRY DRYER HAVING A TEMPERATURE-ACTIVATED AIR-FLOW BLOCKING UNIT

(75) Inventor: Gerhard Stegerwald, Virginia Beach, VA (US)

(73) Assignee: BSH Hausgeräte GmbH, Munich (DE)

( * ) Notice: Subject to any disclaimer, the term of this patent is extended or adjusted under 35 U.S.C. 154(b) by 1211 days.

(21) Appl. No.: 14/345,485

(22) PCT Filed: Sep. 11, 2012

(86) PCT No.: PCT/EP2012/067707

§ 371 (c)(1),
(2), (4) Date: Mar. 18, 2014

(87) PCT Pub. No.: WO2013/037756

PCT Pub. Date: Mar. 21, 2013

(65) Prior Publication Data

US 2014/0338213 A1 Nov. 20, 2014

(30) Foreign Application Priority Data

Sep. 16, 2011 (DE) ..... 10 2011 082 861

(51) Int. Cl.
*F26B 21/12* (2006.01)
*D06F 58/04* (2006.01)

(52) U.S. Cl.
CPC ..... *F26B 21/12* (2013.01); *D06F 58/04* (2013.01)

(58) Field of Classification Search
CPC ..... D06F 58/20; D06F 58/04; D06F 58/02; F26B 21/12
USPC ..... 34/130
See application file for complete search history.

(56) References Cited

U.S. PATENT DOCUMENTS 3,816,226 A * 6/1974 Finelli ..... C08J 5/24 156/278
6,505,418 B1 * 1/2003 Confoey ..... D06F 58/263 34/260
6,521,834 B1 * 2/2003 Dykhoff ..... C09K 21/00 174/66

(Continued)

FOREIGN PATENT DOCUMENTS

DE 10 2007 061521 6/2009
DE 10 2010 031268 1/2012

(Continued)

OTHER PUBLICATIONS

International Search Report for PCT/EP2012/067707 dated Oct. 29, 2012.

(Continued)

*Primary Examiner* — Edelmira Bosques
*Assistant Examiner* — Bao D Nguyen
(74) *Attorney, Agent, or Firm* — Nixon & Vanderhye P.C.

(57) ABSTRACT

The invention relates to a laundry dryer, in particular a domestic laundry dryer, which has a drum intended for laundry to be dried. The drum is provided with at least one air line for supplying air or discharging air. The laundry dryer is characterized in that the air line can be closed by means of a temperature-activated air-flow blocking unit, which contains an expansion material that expands at a temperature caused by a fire to such an extent that the air line is closed thereby.

13 Claims, 3 Drawing Sheets

(56) References Cited

U.S. PATENT DOCUMENTS

Figure 1:
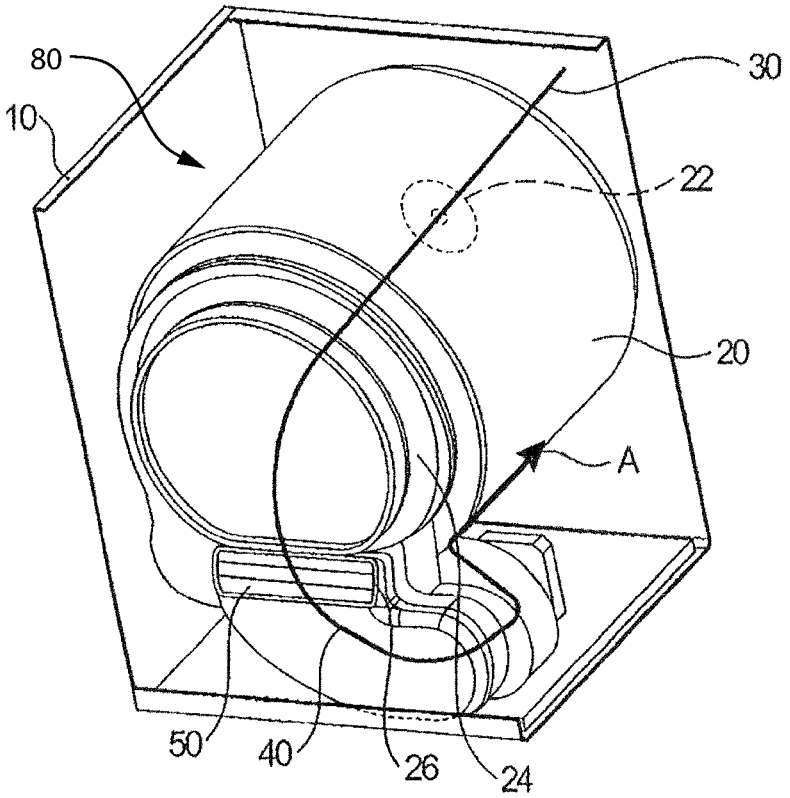

| | | | | |
|---|---|---|---|---|
| 6,855,393 | B1 * | 2/2005 | Ayres | B32B 3/12 428/116 |
| 2007/0017685 | A1 * | 1/2007 | Moore | G11B 33/142 174/17 VA |
| 2009/0159301 | A1 | 6/2009 | Chatot et al. | |
| 2009/0260251 | A1 | 10/2009 | Prajescu et al. | |
| 2010/0175898 | A1 * | 7/2010 | Steinicke | A62C 3/00 169/46 |

FOREIGN PATENT DOCUMENTS

| | | | | |
|---|---|---|---|---|
| DE | 102010031268 | A1 * | 1/2012 | D06F 58/02 |
| EP | 2 458 069 | | 5/2012 | |

OTHER PUBLICATIONS

Written Opinion of the International Searching Authority dated Oct. 29, 2012.

* cited by examiner

LAUNDRY DRYER HAVING A TEMPERATURE-ACTIVATED AIR-FLOW BLOCKING UNIT

This application is the U.S. national phase of International Application No. PCT/EP2012/067707 filed 11 Sep. 2012 which designated the U.S. and claims priority to DE 10 2011 082 861.3 filed 16 Sep. 2011, the entire contents of each of which are hereby incorporated by reference.

The present invention relates to a laundry dryer, in particular a domestic laundry dryer, comprising a drum intended for laundry to be dried, which is provided with at least one air line for supplying air and/or discharging air, wherein said air line can be closed by means of a temperature-activated air-flow blocking unit.

A laundry dryer of this kind is disclosed in DE 10 2007 061 521 A1. This describes a laundry dryer which is equipped with a fire-extinguishing device. This fire-extinguishing device can comprise a valve, which is arranged in an air duct to convey an air flow through a laundry drum, wherein, when the fire-extinguishing device is triggered, the valve can be controlled so that it closes off the air duct.

In the case of laundry dryers, it is repeatedly possible for certain small elements, such as, for example, lint or even small pieces of plastic, to accumulate and become deposited in the drum. When a certain temperature is reached, these elements could catch fire. This needs to be prevented. Some countries already enforce, or will shortly enforce, corresponding test methods to demonstrate that fire is unable to escape from the laundry dryer. To this end, for example, from 2013, tests will be performed in the USA to ensure that a cloth placed over the laundry dryer cannot ignite during the test.

Therefore, manufacturers of laundry dryers are keen to be able offer laundry dryers in which fire can be actively extinguished in the interior of the laundry dryer or in which fire can at least be prevented from escaping to the outside. To this end, it is known that the fire can be actively controlled by extinguishing by means of water or other chemicals once the extinguishing process has been triggered by a temperature sensor. However, a solution of this kind generally requires a functioning power supply to operate the temperature sensor and possibly further mechanisms. Alternatively, it also possible to control the fire passively by no longer using readily combustible plastic parts, but only using fire-resistant plastics or metals. However, this is only possible if higher manufacturing costs are accepted.

The present invention is based on the object of suggesting a laundry dryer, such as, in particular, a domestic laundry dryer, in which a fire occurring in the drum cannot in any way escape from the drum and for it to be extinguished automatically where possible.

This object is achieved with a laundry dryer as claimed in the independent claim. Advantageous developments of the invention are the subject matter of the dependent claims, the following description and the accompanying drawing.

A laundry dryer according to the invention comprises a drum intended to hold laundry to be dried, which is provided with at least one air line for supplying air, discharging air or both. Usually, here, there is an air inlet line to supply hot, dry air to the drum and an air outlet line to discharge moist and cooled air, which, for ease of description are described collectively as "air lines". Obviously, it is also possible for a plurality of air lines of this kind to be provided.

The laundry dryer according to the invention is characterized by the fact that the air line can be closed by means of a temperature-activated air-flow blocking unit containing an expansion material that expands at a temperature such as those caused by a fire that has developed or is developing, to such an extent that the air line is closed thereby. Here, "expansion material" should be understood to be a material, which, from a certain temperature, expands, —wherein the thermal expansion in no way has to be in linear correlation with the temperature, but can also only start when a certain expansion temperature has been reached—to such an extent that the air line is closed thereby. Since, for example, fire in the drum caused by cotton lint, wool lint or small pieces of plastic can easily achieve temperatures of 500° C. to 800° C. and above, it is sufficient for the expansion material to undergo linear expansion and/or volume expansion at a temperature below the temperature range mentioned above, for example at 350° C. to 450° C. This solution according to the invention to the problem described above inter alia has the advantage that it is substantially more cost-effective than active fire extinguishing systems for controlling drum fires. In addition, this solution is completely independent of the power supply of the laundry dryer, since it represents an exclusively "mechanical" solution without any requirement to be connected to a power supply.

According to an advantageous development of the invention, the laundry dryer is characterized by the fact that the air-flow blocking unit comprises a hollow space, which is a part of the air line and contains the expansion material, which, at the temperature that can be caused by a fire, closes the air line in that it expands in a certain—defined or specified—way or in other words increases its volume. In this way, the air-flow blocking unit is able to close the air line directly, without the aid of an intrinsic mechanical or electrical device, in the event of a fire. Hence, no intrinsic mechanical actuation is required for the air-flow blocking unit, in particular no electrical power connection is required for its actuation.

Preferably, the expansion material is arranged in the air line completely filling its cross section and hence is embodied such that it comprises through-holes—and to be precise below the temperature range at which its volume expands—wherein the through-holes are dimensioned such that they become closed on a volume expansion of the expansion material such as that which occurs at a temperature resulting in the case of a fire. Hence, the closure of these through-holes causes the air line to be closed. This embodiment is structurally very simple to produce and functions very reliably without further intervention from outside; hence, it closes the air line very reliably and securely solely and exclusively at the temperature caused by a fire.

According to a further advantageous embodiment of the laundry dryer according to the invention, the expansion material is arranged in the air-flow blocking unit such that it serves as an actuating device for a closing device for closing the air line as soon as it expands its length and/or volume when a temperature such as that caused by a fire is reached. With this embodiment, the expansion material can also be described as a triggering device or as a trigger for a closing device for closing the air line. Here, according to an advantageous development of the invention, the air-flow blocking unit comprises a container holding the expansion material and a locking device for locking the closing device. At the same time, the closing device is kept locked for as long as the expansion material has not yet expanded and the locking occurs in a (first) position in which the air line is open. In other words, the air line remains open for as long as the expansion material has not yet expanded and hence the closing device has not yet become unlocked. Hence, the unlocking of the closing device only takes place when the expansion material expands, wherein the closing device then closes the air line.

According to an advantageous development of this embodiment, the closing device comprises a first plate with first air passages and a second plate with second air passages, wherein the second plate is arranged movably, in particular rotatably relative to the first plate. Here, the arrangement is such that the second air passages can be moved by an actuating device out of a first position, in which they have a fluid connection to the first air passages, into a second position in they do not have a fluid connection to the first air passages. Hence, the movement of the second air passages into the second position closes the air line and therefore prevents the fire from escaping from the drum via the air line. Once again, this embodiment of the invention does not require any mechanical influence from outside or any electrical power connection in order to prevent any fire that occurs from escaping from the drum, but is solely and exclusively triggered or activated by the corresponding increase in temperature. Here, it is of advantage for the actuating device to comprise a spring which strikes the second plate in its first position to move it in the direction of the second position. With this arrangement, the expansion material functions as a blocking device, which prevents the movement of the second plate for as long as the expansion material has not yet expanded and enables or releases a movement of the second plate with the second air passages initiated by the spring when the expansion material has expanded sufficiently and hence released the route for the movement of the second plate.

To ensure the reliability of the automatic activation and for the extent of the action which causes the expansion of the expansion material, it is of advantage for the expansion material to expand by a factor of at least 100%, preferably at least 200%. In other words, at a temperature such as that caused by a fire, the thickness of the expansion material is then at least twice, preferably at least three times, its thickness at room temperature.

A simple and inexpensive embodiment of the present invention is enabled if a fabric, a felt, a foamed material or a similar material is used as the expansion material, wherein this material is preferably formed from ceramic fibers, which in turn are not fire-sensitive, even at high temperatures and hence do not self-ignite.

However, it is also possible advantageously to use the following materials—which should be treated as examples only—as the expansion material:

"Expanding Felt 607" from Thermal Ceramics; this material expands on the occurrence of a fire to at least three times the thickness, it is made of alkaline earth silicate fibers and contains a small quantity of organic binders;

"Palusol" from BASF; this material contains hydrated sodium silicate with a small quantity of organic binder and is preferably coated on both sides with epoxy resin. From about 100° C., the hydrated sodium silicate starts to lose water rapidly and to expand rapidly;

"FyreWrap XFP Expanding Paper" from Unifrax, USA; this material is formed from a composition of alumina silica refractory ceramic fibers, unexpanded vermiculite and an organic binder. This material can be produced as a flexible, swelling mat which, at about 325° C., expands to about three times the thickness. In addition, this material can withstand temperatures up to about 1260° C.

According to a further advantageous development of the invention, the drum of the laundry dryer comprises an air inlet embodied such that the air-flow blocking unit can be arranged in the air inlet. Alternatively or additionally, the drum is advantageously embodied such that it comprises a bearing shield in which this or an additional air-flow blocking unit can be arranged, wherein this air-flow blocking unit is then arranged in the region of the drum's air outlet.

Figure 4:
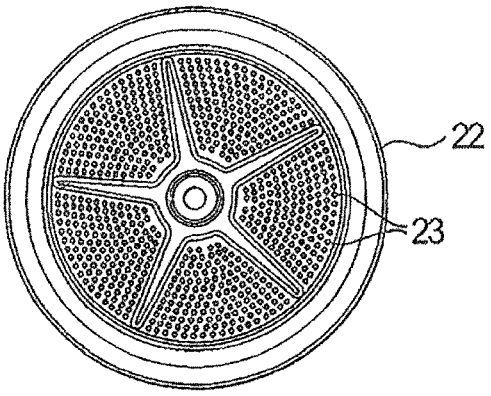
Figure 2:
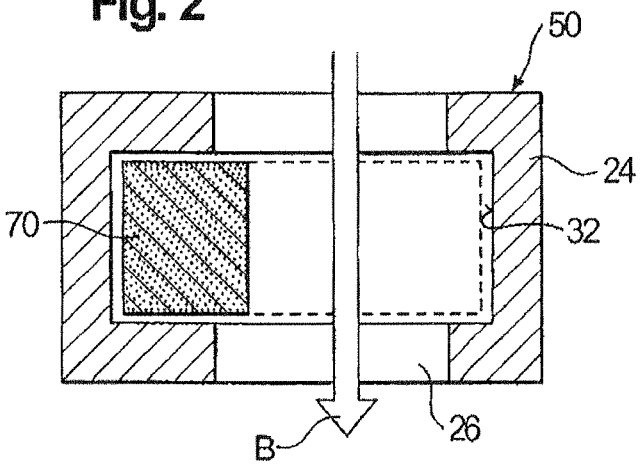
Figure 3:
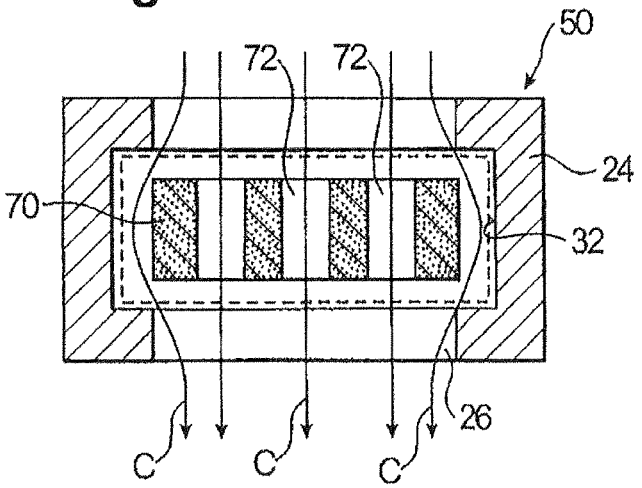
Figure 6:
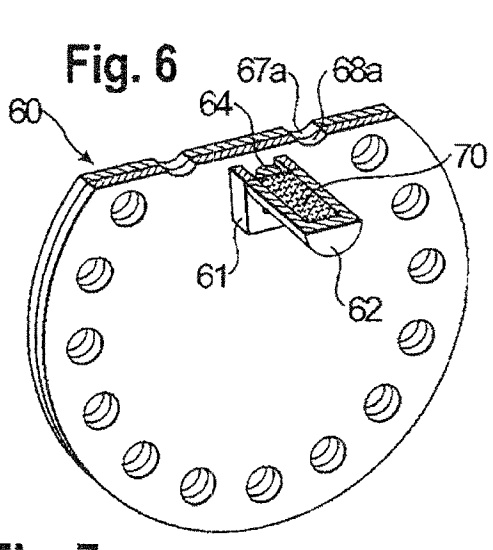
Figure 5:
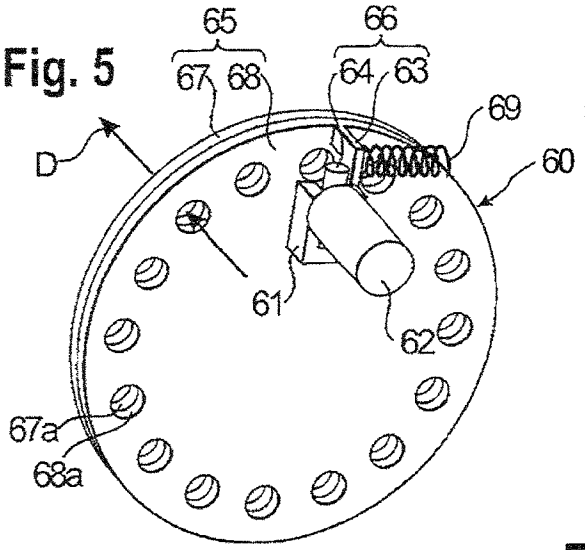
Figure 7:
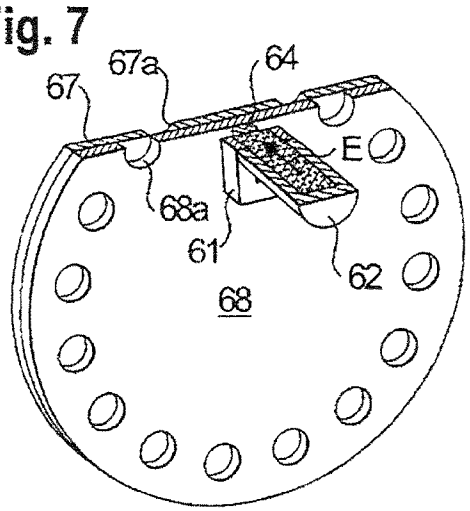
Figure 8:
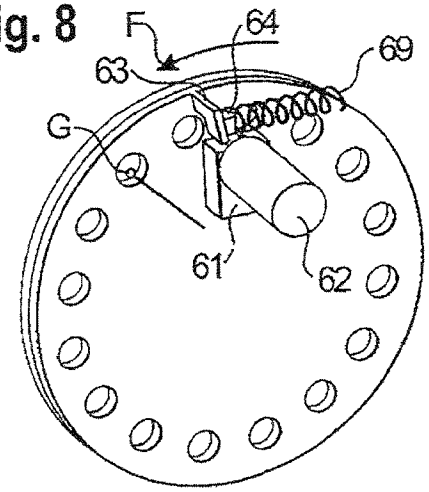
Figure 9:
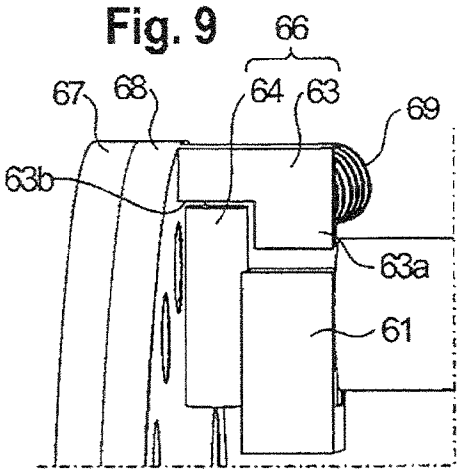

Further advantages, features and special aspects of the invention may be derived from the following description of advantageous embodiments depicted in the figures in the attached drawing, which show:

FIG. 1 a perspective view of a first advantageous embodiment of the laundry dryer;

FIG. 2 a sectional view of an air-flow blocking unit of the first embodiment;

FIG. 3 a sectional view of a variant of the air-flow blocking unit of the first embodiment;

FIG. 4 a front view of an air inlet of a drum of a laundry dryer;

FIG. 5 a perspective view of an air-flow blocking unit of a second advantageous embodiment of the laundry dryer with an open air line;

FIG. 6 a perspective view of the air-flow blocking unit according to FIG. 5 with a locked closing device for the air line with expansion material which has not yet expanded;

FIG. 7 a perspective view of the air-flow blocking unit according to FIG. 5 with an unlocked closing device for the air line with expanded expansion material;

FIG. 8 a perspective view of an air-flow blocking unit according to the second embodiment with an unlocked closing device and closed air line; and FIG. 9 a perspective side view of the unlocked closing device for the air line.

FIG. 1 is a schematic perspective view obliquely from above of a drum 20 of a laundry dryer 10. The drum 20 is spaced from an upper surface of the laundry dryer housing by a buffer volume 80. On the rear side shown, an air inlet 22 in the form of a perforated disc is provided through which the air can flow into the drum 20. FIG. 4 shows a detailed view of this air inlet 22 in front view. FIG. 4 shows in detail that the air inlet 22 comprises a plurality of small holes 23 through which the air can flow out of the air line 30, which is only schematically indicated here, into the drum 20. Here, the air inlet 22 is arranged in a housing (not shown) into which the air line 30 discharges and in which the air inlet 22 is inserted in an air-tight manner.

From the air inlet 22, air can flow through the drum 20 and leaves the drum 20 again via an air outlet 26 (only shown schematically) which is provided in a bearing shield 24, and leaves the laundry dryer 10 again via an air duct 40 via an air flow, which is indicated by means of an arrow A. An air-flow blocking unit 50 is arranged in the bearing shield 24 wherein FIG. 2 and FIG. 3 show two variants of this air-flow blocking unit 50. FIGS. 2 and 3 show sections through the two variants of the air-flow blocking unit 50 along a plane containing the axis of the drum 20.

It is evident in FIG. 2 that an expansion material 70 is arranged in a hollow space 32 located in the air outlet 26 in the bearing shield 24. According to FIG. 2, the expansion material 70 only occupies a small part of the hollow space 32—in this embodiment, less than half—so that air can easily flow through the air line through the air outlet 26; in FIG. 2, this is indicated symbolically by an arrow B. Here, the expansion material 70 is embodied such that, when a certain temperature is reached, such as that caused by the occurrence of a fire, its width or thickness or its volume expands to such an extend that it occupies the entire hollow space 32 and any marginal gaps between the expansion material 70 and the hollow space 32 are automatically closed. This situation is shown schematically in FIG. 2 with dashed lines. It is namely evident from FIG. 2 that the volume of the expanded expansion material 70 is much greater than in the non-expanded situation. This blocks the air flow through the air outlet 26 very reliably.

Alternatively to the above described embodiment of the expansion material 70, the expansion material 70 can also be provided with through-holes 72 and/or embodied such that its thickness and/or its diameter is smaller than the hollow space 32 in which it is located to such a degree that the expansion material 70 in the hollow space 32—possibly additionally or alternatively by means of the flow through the through-holes 72—can be easily circulated or permeated by the air flow and does not impede it, or at least does not impede it substantially, at the outlet through the air outlet 26. This is indicated schematically by arrows C which indicate partial air flows. It is evident that, on the occurrence of a fire, due to the expansion caused thereby, the expansion material 70 located in the hollow space 32 automatically prevents the escape of air from the air outlet 26 in that its increase in thickness and/or volume causes the air line 30 or 40, which includes the hollow space 32 or the air outlet 26, to close. The expanded state, in which the through-holes 72 are shown, is shown as a dashed line in FIG. 2. Hence, in both variants of this advantageous first embodiment, the expansion material 70 acts directly by means of its increase in thickness or volume.

FIGS. 5 to 9 show an air-flow blocking unit 60 according to a second embodiment of the laundry dryer 10. This air-flow blocking unit 60 is installed in an air line—that is a line for supplying or removing air—wherein this is not shown in the drawing.

According to FIG. 5, the air-flow blocking unit 60 comprises a first plate 67, here shown as circular, which is arranged fixed with respect to the laundry dryer 10. Lying on the first plate 67, there is a second plate 68, which is here also shown as circular, which is in turn arranged rotatably with respect to the first plate 67. Here, the second plate 67 rotates around its middle axis standing vertically to the surface. The two plates 67 and 68 each comprise air through-holes 67*a* or 68*a*, which in the position shown in FIG. 5—which is here shown the as the first position of the second plate 68—are in alignment and hence, due to the fluid connection established hereby, permit an air passage vertical to the surfaces of the two plates 67, 68. A locking device 66 is provided in order to hold the two plates 67, 68 in this position relative to each other, i.e. the second plate 68 in its first position. The locking device 66 comprises a bolt guide housing 61, in which a stop bolt 64 which is displaceable parallel to the axis of the plates 67, 68 is arranged. An angled attachment plate 63 firmly fixed to the second plate 68 (see also FIG. 9) is embodied such that it comprises an attachment section 63*a*, which, in the first position of the second plate 68, lies on the displaceable stop bolt 64. Since an actuating device 69 is provided (here embodied as a spring) which applies pressure to the attachment section 63*a* so that it presses on the stop bolt 64, the second plate 68 is fixed thereby relative to the first plate 67. In this position, the actuating device 69 also takes on the function of a locking device. A container 62 (here shown as cylindrical), the function and embodiment of which will be explained below, extends from the bolt guide housing 61 and the stop bolt. In FIG. 5, an arrow D symbolically represents the air flow passing through the plates 67, 68.

In FIG. 6, the container 62, the bolt guide housing 61 and the displaceable stop bolt 64 are shown cut open. The container 62 contains an expansion material 70, which can be expanding felt, expanding fabric or a corresponding expanding fiber material. Instead of these, the expansion material could also be enclosed water, another fluid or a solid, which, on exposure to heat, increases its volume or length or thickness sufficiently enough to perform the function of a triggering device for closing the air line. As is evident from the depiction in FIG. 6, the expansion material 70 only occupies the space that the container 62 makes available to it.

As soon as a temperature is achieved in or on the plates 67, 68 and hence on the container 62 such as that caused by combustion or a fire, the expansion material 70 expands and thereby presses the displaceable stop bolt 64 away from the container onto the second plate 68 until the stop bolt 64 is located close to the second plate 68 or lies thereupon. This situation is depicted in FIG. 9, wherein here, for purposes of clarity, the bolt guide housing 61 in the region of the second plate 68 is not depicted in order to be able to depict the stop bolt 64 displaced toward the second plate 68 more clearly. The expansion of the expansion material 70 is indicated symbolically in FIG. 7 by an arrow E. As is also evident from FIG. 9, the attachment plate 63 is embodied such that it comprises a recess 63*b* between the attachment section 63*a* and the second plate 68, which is embodied such that, in the position of the stop bolt 64 in FIG. 9, the attachment plate 63 or its attachment section 63*a* no longer lies on the stop bolt 64, but allows the stop bolt 64 to pass. As soon as the attachment section 63*a* no longer lies on the stop bolt 64, the compressive force of the actuating device 69, embodied as a spring, impacting on the attachment plate 63 causes the second plate 68 to twist into a second position and, to be precise, according to the depiction in FIG. 8 in counter-clockwise direction, which is indicated by an arrow F. As soon as the second plate 68 has twisted far enough, the air through-holes 67*a* of the first plate 67 are no longer in alignment with the air through-holes 68*a* of the second plate 68 thereby causing the air flow through the plates 67, 68 to be blocked. The blocked air flow is indicated symbolically in FIG. 8 by a circle G. Hence, the plates 67, 68 form a closing mechanism 65.

Hence, with the second embodiment of the laundry dryer, the air line can be closed indirectly by the increase in volume or length of the expansion material 70. In other words, here, the expansion material 70 serves as a trigger for the closing mechanism 65 surrounding the plates 67, 68.

Obviously, the invention described above is not restricted to the two embodiments described in detail. The different variants of the temperature-activated air-flow blocking unit described above can be used in both condenser dryers and tumble dryers and each guarantee reliable and automatic closure of the air line or the air lines in the case of a fire, without requiring any external influence. Since there is no requirement for connection to the mains or the provision of a battery etc. for the operation, or maintenance of standby mode, of the air-flow blocking unit, the fault tolerance of the air-flow blocking unit is also very high. It should be noted that, features of the invention described with respect to individual embodiments, such as, for example, the embodiment and arrangement of the two plates or of the hollow space to accommodate the expansion material and their dimensions and the materials used, can also be present individually or in combination, unless specified otherwise or impossible for technical reasons.

LIST OF REFERENCE CHARACTERS

10 Laundry dryer
20 Drum

22 Air inlet
23 Central hole
24 Bearing shield
26 Air outlet
30 Air line
32 Hollow space
40 Air line
50 Air-flow blocking unit
60 Air-flow blocking unit
61 Bolt guide housing
62 Container
63 Installation plate
63*a* Attachment section
63*b* Recess
64 Displaceable stop bolt
65 Closing device
66 Locking device
67 First plate
67*a* Air through-hole
68 Second plate
68*a* Air through-hole
69 Actuating device/spring
70 Expansion material
A Air flow
B Air flow
C Partial air flows
D Air flow
E Expansion
F Rotation
G Interrupted air flow

The invention claimed is:

1. A laundry dryer, comprising a drum intended for laundry to be dried, which is provided with at least one air line for supplying air and/or discharging air, wherein said air line can be closed via a temperature-activated air-flow blocking unit, wherein the air-flow blocking unit contains an expansion material configured to expand at a temperature caused by a fire from lint or pieces of plastic within the drum to such an extent that the air line is closed thereby, which prevents the fire from escaping from the drum, in use, and wherein the drum is located within a laundry housing, wherein:

the air-flow blocking unit comprises a hollow space which is part of the air line and in which the expansion material is arranged, which closes the air line at the temperature caused by the fire caused by volume expansion, and while it has not yet undergone volume expansion, the expansion material has through-holes, which, on volume expansion as a result of the temperature caused by the fire, thus causes the air line to be closed.

2. The laundry dryer as claimed in claim 1, wherein, at the temperature caused by the fire, an expanded thickness of the expansion material is at least twice a room temperature thickness of the expansion material.

3. The laundry dryer as claimed in claim 1, wherein the expansion material is a fabric or felt material.

4. The laundry dryer as claimed in claim 1, wherein the drum comprises:

an air inlet, in which the air-flow blocking unit is arranged, and/or a bearing shield, in which the air-flow blocking unit is arranged.

5. The laundry dryer as claimed in claim 2, wherein the expanded thickness of the expansion material is at least three times the room temperature thickness of the expansion material.

6. The laundry dryer as claimed in claim 1, wherein the expansion material is a foamed material.

7. The laundry dryer as claimed in claim 1, wherein the expansion material is a fabric, felt, or foamed material, or the expansion material is formed from ceramic fibers.

8. The laundry dryer as claimed in claim 1, wherein the material is configured to expand once an interior temperature reaches a temperature limit.

9. The laundry dryer as claimed in claim 1, wherein the laundry dryer is configured to receive wet laundry.

10. The laundry dryer as claimed in claim 1, wherein the laundry dryer is a domestic laundry dryer.

11. The laundry dryer as claimed in claim 1, wherein the air flow blocking unit is configured to expand at the temperature caused by a developing fire.

12. The laundry dryer as claimed in claim 1, wherein the expansion material expands between 350 and 450° C.

13. The laundry dryer as claimed in claim 1, wherein a buffer volume is located between the drum and the laundry housing, wherein the temperature-activated air-flow blocking unit is positioned at an outlet of the drum to inhibit the fire from escaping from the drum to the buffer volume.

* * * * *